US009930916B2

(12) United States Patent
Hays et al.

(10) Patent No.: US 9,930,916 B2
(45) Date of Patent: Apr. 3, 2018

(54) FLOCKED SHAPEWEAR GARMENTS

(71) Applicant: Spanx, Inc., Atlanta, GA (US)

(72) Inventors: Tosha L. Hays, Atlanta, GA (US); Sylma Colon-Otten, Atlanta, GA (US)

(73) Assignee: Spanx, Inc., Atlanta, GA (US)

( * ) Notice: Subject to any disclaimer, the term of this patent is extended or adjusted under 35 U.S.C. 154(b) by 180 days.

(21) Appl. No.: 14/822,280

(22) Filed: Aug. 10, 2015

(65) Prior Publication Data

US 2015/0342265 A1 Dec. 3, 2015

Related U.S. Application Data

(63) Continuation of application No. 13/957,101, filed on Aug. 1, 2013, now Pat. No. 9,179,713.

(51) Int. Cl.

| | |
|---|---|
| ***A41C 1/12*** | (2006.01) |
| ***A41C 1/08*** | (2006.01) |
| ***A41C 5/00*** | (2006.01) |

(52) U.S. Cl.

CPC ..... *A41C 1/12* (2013.01); *A41C 1/08* (2013.01); *A41C 5/00* (2013.01)

(58) Field of Classification Search

CPC .... A41C 1/08; A41C 1/12; A41C 1/00; A41C 3/00; A41C 5/00; A41D 27/10

USPC ..... 450/81, 88; 2/69, 247.1

See application file for complete search history.

(56) References Cited

U.S. PATENT DOCUMENTS

| | | | |
|---|---|---|---|
| 1,156,757 | A | 10/1915 | Collett |
| 1,909,273 | A | 5/1933 | Hennessy et al. |
| 2,168,009 | A | 8/1939 | Praag |
| D123,777 | S | 12/1940 | Greco |
| 2,250,218 | A | 7/1941 | Cadous et al. |
| D132,058 | S | 4/1942 | Sarge |
| 2,305,736 | A | 12/1942 | Rhea |
| 2,310,864 | A | 2/1943 | Pegg |
| RE23,202 | E | 3/1950 | Long |
| 2,527,926 | A | 10/1950 | Frischer |
| 2,531,769 | A | 11/1950 | Desrochers et al. |
| D165,698 | S | 1/1952 | Rockwell |
| 2,644,945 | A | 7/1953 | Lewis |
| 2,758,310 | A | 8/1956 | Lewis et al. |
| D179,336 | S | 12/1956 | Bayer et al. |
| 3,168,099 | A | 2/1965 | Morano |
| 3,339,554 | A | 9/1967 | Nobbs |
| 3,393,675 | A | 7/1968 | Trznadel et al. |
| 3,431,913 | A | 3/1969 | Bugnon et al. |

(Continued)

FOREIGN PATENT DOCUMENTS

| | | |
|---|---|---|
| DE | 19942996 | 3/2001 |
| FR | 2808972 | 11/2001 |

(Continued)

OTHER PUBLICATIONS

Non Final Office Action issued in Design U.S. Appl. No. 29/565,714 dated Jan. 23, 2017.

(Continued)

*Primary Examiner* — Gloria Hale

(74) *Attorney, Agent, or Firm* — Meunier Carlin & Cufman LLC

(57) ABSTRACT

Disclosed herein are flocked shapewear garments. The flocked shapewear garments comprise a fabric, an elastomeric coating, and flocking fibers embedded in the elastomeric coating.

4 Claims, 3 Drawing Sheets

(56) References Cited

U.S. PATENT DOCUMENTS

| | | | |
|---|---|---|---|
| D213,667 | S | 4/1969 | Salisky |
| D213,947 | S | 4/1969 | Dubner |
| 3,683,935 | A | 8/1972 | Rosner |
| 3,813,697 | A | 6/1974 | Belpaume |
| D238,623 | S | 2/1976 | Lo Casclo |
| 5,465,594 | A | 11/1995 | Imboden et al. |
| 5,756,180 | A | 5/1998 | Squires et al. |
| 5,863,633 | A | 1/1999 | Squires et al. |
| 5,944,708 | A | 8/1999 | Philpott |
| 6,430,752 | B1 | 8/2002 | Bay |
| 6,874,337 | B2 | 4/2005 | Uno |
| 7,074,204 | B2 | 7/2006 | Fujii et al. |
| 7,087,032 | B1 | 8/2006 | Ikeda |
| 7,418,742 | B2 | 9/2008 | Yoo |
| 7,509,822 | B2 | 3/2009 | Ishida |
| 7,559,093 | B2 | 7/2009 | Sudo et al. |
| D622,477 | S | 8/2010 | Schindler |
| D642,768 | S | 8/2010 | Sawle et al. |
| D645,644 | S | 9/2011 | Iamartino |
| D654,247 | S | 2/2012 | Osbourne |
| D661,872 | S | 6/2012 | Iamartino |
| D662,281 | S | 6/2012 | Iamartino |
| 8,381,314 | B2 | 2/2013 | Takamoto |
| D692,208 | S | 10/2013 | LaCour-Phillippi |
| 8,752,216 | B2 | 6/2014 | Sawle et al. |
| D707,920 | S | 7/2014 | Hays et al. |
| 8,784,351 | B2 | 7/2014 | Dumpson |
| 8,850,619 | B2 | 10/2014 | Rush |
| D730,624 | S | 6/2015 | Prpic et al. |
| D733,994 | S | 7/2015 | Hays et al. |
| 9,179,713 | B2 | 11/2015 | Hays |
| D760,471 | S | 7/2016 | Hayes et al. |
| 2001/0008672 | A1 | 7/2001 | Norvell et al. |
| 2004/0107479 | A1 | 6/2004 | Dicker |
| 2008/0292788 | A1 | 11/2008 | Giloh |
| 2009/0038047 | A1 | 2/2009 | Di Lorenzo |
| 2009/0221982 | A1 | 9/2009 | Cecconi et al. |
| 2009/0271914 | A1 | 11/2009 | Bauer |
| 2011/0083246 | A1* | 4/2011 | Vitarana ..... A41D 13/0015 2/69 |
| 2011/0314590 | A1 | 12/2011 | Perron |
| 2012/0164406 | A1 | 6/2012 | Sawle |
| 2013/0186150 | A1 | 7/2013 | Pilawa et al. |
| 2014/0208484 | A1 | 7/2014 | Huff et al. |
| 2015/0038052 | A1 | 2/2015 | Hays |
| 2015/0296894 | A1 | 10/2015 | Turlan-Van Der Hoeven et al. |

FOREIGN PATENT DOCUMENTS

| | | |
|---|---|---|
| WO | 03034853 | 5/2003 |
| WO | 2009133469 | 11/2009 |
| WO | 2011/045655 | 4/2011 |

OTHER PUBLICATIONS

Spanx Skinny Britches Open-Bust Mid-Thigh Body (on-line); Article for sale with reviews posted to Amazon.com as early as Jun. 20, 2013. Retrieved from the internet on Sep. 25, 2014. URL: http://www.amazon.com/SPANX-Britches-Open-Bust-Mid-Thigh-Natural/dp/B00945C8QQ/ref=cm_cr_pr_pb_i. (7 pgs).

English-language abstract for DE19942996, published Mar. 15, 2001, from Espacenet (downloaded Nov. 19, 2013).

English-language abstract for FR2808972, published Nov. 23, 2001, from Espacenet (downloaded Nov. 19, 2013).

Design U.S. Appl. No. 29/462,332 to Tosha L. Hays and Sylma Colon-Otten, filed Aug. 1, 2013, and issued Jul. 14, 2015, and the prosecution history thereof.

Design U.S. Appl. No. 29/462,338 to Tosha L. Hays and Sylma Colon-Otten, filed Aug. 1, 2013, and issued Jul. 1, 2014, and the prosecution history thereof.

Design U.S. Appl. No. 29/488,647 to Tosha L. Hays and Sylma Colon-Otten, filed Apr. 22, 2014, and the prosecution history thereof.

Design U.S. Appl. No. 29/529,616 to Tosha L. Hays and Sylma Colon-Otten, filed Jun. 9, 2015, and the prosecution history thereof.

Utility U.S. Appl. No. 13/957,101 to Tosha L. Hays, filed Aug. 1, 2013, and the prosecution history thereof.

Spanx Skinny Britches Open-Bust Mid-Thigh Body, cited in Office Action dated Oct. 3, 2014, available at URL: http://www.spanx.com/ . . . ar/style/open-bust/skinnybritches-open-bust-mid-thigh-body-zid38-1909/cat-38-catidfncat_spx_sw_styl_openb?CategoryDomainName=SPXNA-38&var_id=38-1909 &_t=pfm%3Dcategory%26pfmvalue%3Dfaceted.

Skinny Britches Underbust Mid Thigh Shaper, cited in Office Action dated Oct. 3, 2014, available at URL: http://shop.nordstrom.com/s/spanx-skinny-brithces-underbustmid-thigh-shaper/3465205.

Spanx Skinny Britches Super Open-Bust Mid-Thigh Body Shaper, cited in Office Action dated Oct. 3, 2014, available at URL: http://www.zappos.com/spanx-skinnybritches-super-open-bust-mid-thigh-body-shaper?orderBy=latest.

Skinny Britches Mid-Thigh Shaper (on-line); Cited in copending U.S. Appl. No. 29/462,332, Similar article for sale with reviews posted to Nordstrom.com as early as May 3, 2013. Retrieved from the internet on Feb. 2, 2015. URL: http://shop.nordstrom.com/s/spanx-skinny-britches-mid-thigh-shaper/3465206.

* cited by examiner

FLOCKED SHAPEWEAR GARMENTS

RELATED APPLICATIONS

This application is a continuation of U.S. patent application Ser. No. 13/957,101, filed Aug. 1, 2013, which is incorporated by reference in its entirety for all purposes.

FIELD OF THE DISCLOSURE

The present disclosure relates to flocked shapewear garments, comprising a fabric, an elastomeric coating, and flocking fibers embedded in the elastomeric coating.

BACKGROUND

Many people face recurring problems with bulges of undesirable body fat on their torso (e.g., abdominal fat, back fat, etc.) and or legs (e.g., thigh fat). Designers have produced a variety of garments designed to restrain, smooth, and conceal undesirable bulges of body fat. However, a need exists for more comfortable garments that can restrain, smooth, and conceal undesirable bulges of body fat in targeted areas.

SUMMARY OF THE DISCLOSURE

Disclosed herein are flocked shapewear garments comprising a fabric, an elastomeric coating on at least the portion of the fabric configured to cover the abdominals of the garment wearer, and flocked fibers embedded in the elastomeric coating, wherein the garment comprises a sufficient amount of elastomeric coating and flocked fibers to provide compression to the abdominal area of the garment wearer. In some embodiments, the elastomeric coating is in an X-pattern over the abdominal region of the garment wearer. The flocked shapewear garment can alternatively comprise a fabric, an elastomeric coating on at least the portion of the fabric configured to cover the inner thighs and/or the outer thighs of the garment wearer, and flocked fibers embedded in the elastomeric coating, wherein the garment comprises a sufficient amount of elastomeric coating and flocked fibers to provide compression to the thigh area of the garment wearer. In some embodiments, the fabric comprises from 40% to 80% nylon. In some embodiments, the fabric comprises an elastomer fiber. In some embodiments, the elastomer fiber is spandex, and wherein the fabric comprises from 20% to 60% spandex. In some embodiments, the elastomeric coating comprises silicone.

Also disclosed herein is a flocked shapewear garment for tummy control of a wearer, the garment comprising a fabric panel configured to extend anteriorly over the wearer, and a flocked portion of the fabric panel, the flocked portion having a tummy covering portion and a pair of lateral portions extending laterally therefrom, at least one of the lateral portions having at least one bifurcation defining a cutout portion. The cutout portion can expand progressively as it extends laterally to the adjacent hip of the wearer. In some embodiments, both of the lateral portions have bifurcations defining the cutout portions. The flocked portion can includes superior and inferior edges. The superior and inferior edges have a minimal distance from each other over the tummy (e.g., from 6 inches to 15 inches). In some embodiments, the superior and inferior edges progressively diverge from each other extending away from the tummy in the lateral direction. The superior and inferior edges can have a minimal distance from each other of from 8 inches to 18 inches in the lateral portions. In some embodiments, the cutout portions are located nearer to the superior edge than to the inferior edge.

The details of one or more embodiments are set forth in the description below. Other features, objects, and advantages will be apparent from the description and from the claims.

DETAILED DESCRIPTION

Figure 1:
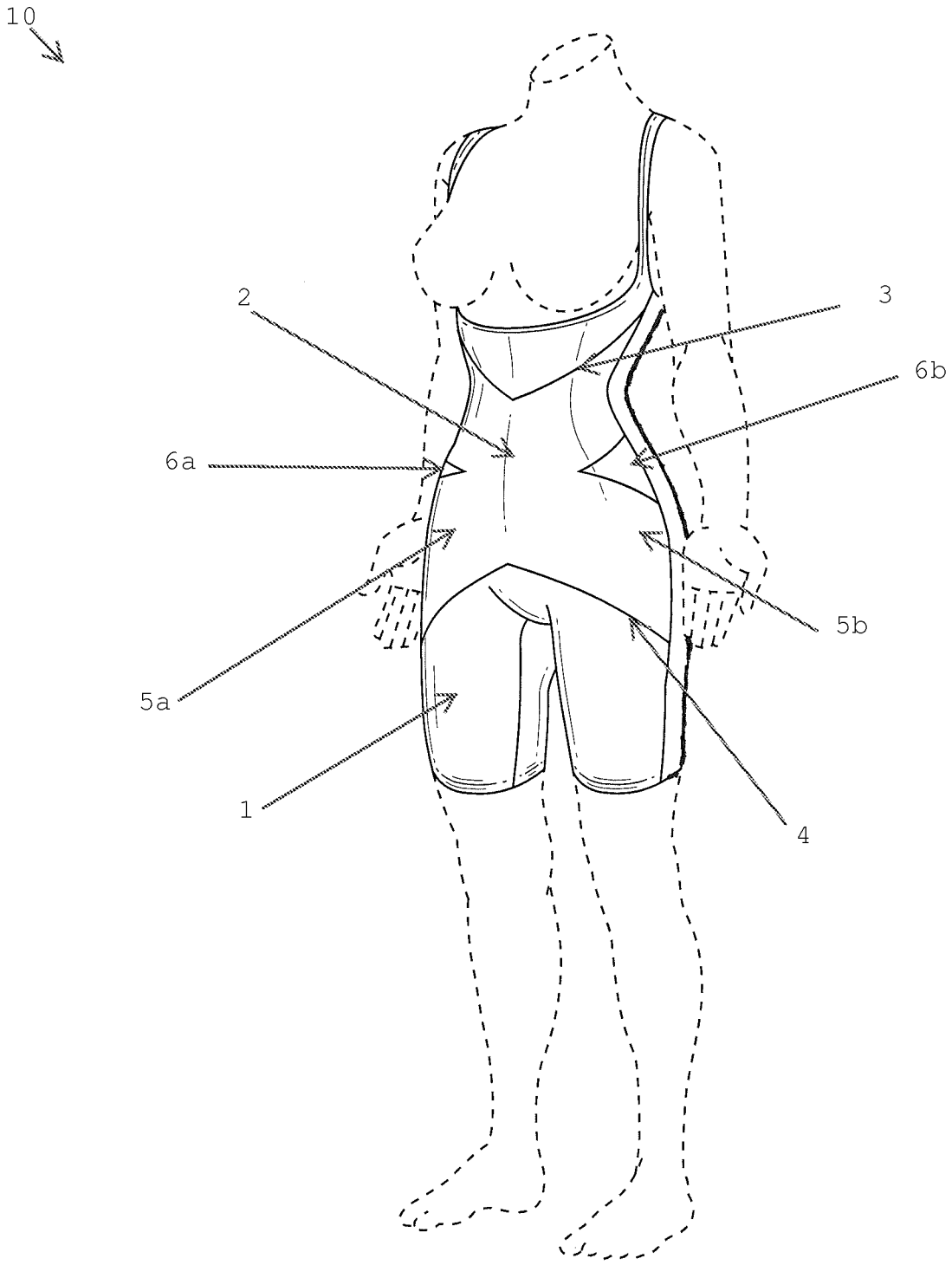
FIG. 1 depicts an anterior perspective view of one embodiment of a flocked shapewear garment disclosed herein.

Disclosed herein are flocked shapewear garments. The flocked shapewear garments comprise a fabric, an elastomeric coating, and flock fibers embedded in the elastomeric coating.

The fabric can be any fabric known in the art for use in garments such as shapewear. The flocked shapewear garments disclosed herein can be any garment wherein restraining, smoothing, or concealing bulges of fat (e.g., abdominal fat or leg fat) could be desirable. In some embodiments, the flocked shapewear garment is a pair of pants, jeans, a pair of shorts, underwear, a panty, Capri pants, a slip, a half-slip, a mid-thigh pant, a skirt, leggings, or tights. In some embodiments, the garment is a shirt, t-shirt, camisole, strapless top, tube top, brassiere, bustier, or tank-top.

The garment can comprise any fabric or fibers known in the art for use in a shapewear garment. The garment can comprise a natural fabric or fiber, a synthetic fabric or fiber, or a blended fabric comprising multiple fibers, so long as adequate compression is provided to give the desired smoothing, contouring, restraining/concealing body fat, or combinations thereof to the garment wearer. In some embodiments, the flocked shapewear garment comprises denim, twill, woven fabric, or knit fabric. Exemplary flocked shapewear garments can comprise, for example, cotton, leather, faux leather, suede, faux suede, polyester, denim, twill, tweed, wood pulp, bamboo, corn fibers, leaves, moleskin, barkcloth, barathea, silk, rayon, nylon, wool, batiste, Bedford cord, bengaline, acetate, berber fleece, burlap, flannel, canvas, lace, goat skin, satin, sateen, charmeuse, cheesecloth, corduroy, linen, crinoline, velvet, spandex, animal pelts, faux animal pelts, jersey, terry cloth, velour, velveteen, nonwoven fabrics such as felt, and blends thereof. The flocked shapewear garment can comprise any number of layers of fabric. In some embodiments, the flocked shapewear garment comprises one layer. In some embodiments, the flocked shapewear garment comprises two layers. The flocked shapewear garment can comprise, for instance, a bonded fabric comprising two or more layers joined together with, for instance, an adhesive, resin, foam, fusible membrane, or sewn together. The flocked shapewear garment can be reversible (e.g., inside-out reversible or forward/backward reversible) to give garment wearers a variety of options for wearing the flocked shapewear garments disclosed herein.

In some embodiments, the flocked shapewear garment comprises an elastomer fiber. In some embodiments, the elastomer fiber is spandex. In some embodiments, the flocked shapewear garment comprises a spandex blend. In some embodiments, the flocked shapewear garment comprises a polyester/spandex blend. In some embodiments, the flocked shapewear garment comprises a nylon/spandex blend. In some embodiments, the flocked shapewear garment comprises a rayon/spandex blend. In some embodiments, the flocked shapewear garment comprises a nylon/lycra blend. In some embodiments, the flocked shapewear garment comprises a polyester/lycra blend. In some embodiments, the flocked shapewear garment comprises a rayon/lycra blend. In some embodiments, the flocked shapewear garment comprises 50% or less of spandex (e.g., 40% or less, 35% or less, 30% or less, 25% or less, 20% or less, or 15% or less). In some embodiments, the flocked shapewear garment comprises 10% or greater of spandex (e.g., 15% or greater, 20% or greater, 25% or greater, 30% or greater, 35% or greater, or 40% or greater). In some embodiments, the flocked shapewear garment comprises 90% or less of nylon (e.g., 85% or less, 80% or less, 75% or less, 70% or less, or 60% or less). In some embodiments, the flocked shapewear garment comprises 50% or greater of nylon (e.g., 60% or greater, 65% or greater, 70% or greater, 75% or greater, 80% or greater, or 85% or greater). In some embodiments, the flocked shapewear garment comprises 40% or less of polyester (e.g., 30% or less, 25% or less, 20% or less, 15% or less, or 10% or less). In some embodiments, the flocked shapewear garment comprises 5% or greater of polyester (e.g., 10% or greater, 15% or greater, 20% or greater, 25% or greater, 30% or greater, or 35% or greater). In some embodiments, the flocked shapewear garment comprises nylon and spandex. The flocked shapewear garment can be made, for instance, by circular knitting, warp knitting, or any weaving or knitting technique known in the art. In some embodiments, the flocked shapewear garment has varied properties. For instance, the flocked shapewear garment can have a gradient of elasticity, horizontally or vertically across the flocked shapewear garment. In some embodiments, the flocked shapewear garment comprises a denser fabric in portions needing additional contouring. In some embodiments, the flocked shapewear garment comprises a double layer with sandwiched elastic at the waist. In some embodiments, the flocked shapewear garment comprises a single layer with no elastic.

The fabric or fiber composition of the panels can impact the compression. Compression can be measured by the modulus and elongation in accordance with, for instance, ASTM 4964.

In some embodiments, the flocked shapewear garment is seamless. In some embodiments, the flocked shapewear comprises cut panels. In some embodiments, the cut panels include a front portion and a back portion. The cut of the panels can be adjusted to affect the compressibility of the garment in targeted areas. In some embodiments, the garment (and the panels therein) are cut in an hour-glass shape to provide additional compression to the garment wearer's waist. The panels can be attached together by any means capable of attaching garment layers together. The front portion and the back portion of the garment can be attached together by any means capable of attaching garment sections together. In some embodiments, the panels and/or sections are attached together by sewing, serging, zipping, buttoning, snapping, heat sealing, welding, gluing, bonding, laser cutting, and combinations thereof. In the two-layer garments of some embodiments, the bottoms of the panels can be attached by bonding for a smoother appearance. In some embodiments, the lateral edges of the panels or portions can be attached by sewing.

The garment can comprise a gusset comprising natural fibers (e.g., cotton).

The elastomeric coating can be a coating that flocked fibers can be embedded in, that is also compatible with the fabrics described above, and that can provide the desired control of the garment wearer's undesirable fat bulges. In some embodiments, the elastomeric coating comprises silicone. Getting elastomeric coating to withstand normal wear and tear by a garment wearer (for instance, by undergoing twenty wash cycles without the elastomeric coating peeling off or disintegrating) when applied to some of the types of fabrics (e.g., certain synthetic fabrics) that can be used for shapewear was difficult.

The elastomer-coated portion of the flocked shapewear garment can be configured to extend across, for instance, a garment-wearer's abdominal region to a greater or lesser amount, depending on the amount of abdominal compression desired by the garment wearer. And in embodiments where more of the garment-wearer's abdominal region can be covered by the elastomer-coated portion of the flocked shapewear garment, greater smoothing, restraining, and/or concealing of undesirable bulges of abdominal fat can be achieved. The elastomer-coated portion of the flocked shapewear garment can be configured in any shape (e.g., full panel around abdominals, circular pattern over abdominals, X-pattern over abdominals) or position (e.g., lower abdominals, upper abdominals, or both) to maximize abdominal compression. Further, the flocked shapewear garments disclosed herein conveniently reduce or eliminate the undesirable fat bulges of the garment wearer while providing, for instance, enhanced breathability of the fabric in areas where smoothing, restraining, and/or concealing of undesirable bulges of fat is not needed. Additionally, the flocked fabric is smooth and soft, eliminating or reducing undesirable fat bulges while maximizing comfort for the garment wearer.

The elastomer-coated portion of the flocked shapewear garment can be configured to extend across, for instance, a garment-wearer's thigh region to a greater or lesser amount, depending on the amount of thigh compression is desired by the garment wearer. And in embodiments where more of the garment-wearer's thigh region can be covered by the elastomer-coated portion of the flocked shapewear garment, greater smoothing, restraining, and/or concealing of undesirable bulges of thigh fat can be achieved. The elastomer-coated portion of the flocked shapewear garment can be configured in any shape (e.g., full panel around thighs, straight panels down thighs, curved panels down thighs) or position (e.g., inner thighs, outer thighs, or both) to maximize thigh compression.

Flocked fabrics can be made by any known method for making flocked fabrics (e.g., as described in U.S. Patent Application Publication No. 2009/0271914). For instance, flocked fabrics can be made using a silkscreen configuration for applying an elastomeric coating to a garment, and then adding flock fibers to the elastomeric coating. For instance, a fabric can be placed beneath a silkscreen on an area where an elastomeric coating is desired. An elastomeric coating substance can be passed through screen apertures of a silkscreen using squeegees. In some embodiments, the elastomeric coating substance is transferred to the fabric by capillary action in controlled and prescribed quantities to form an elastomeric coating on the fabric. The apertures can be provided in a wide variety of patterns and squeegees can be operated in a number of orientations and directions. The elastomeric coating can form a three dimensional (3D) structure on the fabric. The thickness of the 3D structure can be determined by parameters including, but not limited to, the distance between the garment and the silkscreen, the dimension of the apertures of the silkscreen, and the viscosity of the elastomeric coating substance. Hereinafter, "thickness" refers to the dimension of the elastomeric coating from the elastomeric coating/fabric interface to the top of the elastomeric coating.

Alternatively, an elastomeric coating substance can be sprayed onto a fabric with or without a silkscreen. The thickness of the coating can vary, and depends on the type and configuration of the fabric (e.g., the type and size of fabric used), as well as customer requirements. A stencil other than that of a silkscreen configuration can also be used to further enhance the process, whereby a stencil with a particular pattern is placed on the fabric and the elastomeric coating sprayed through the stencil onto the fabric to achieve desired pattern on the fabric.

Alternatively, an elastomeric coating can also be applied to a fabric by a process of extrusion, whereby an elastomeric coating substance is extruded onto the fabric in controlled and prescribed quantities, and can be applied in the form of pre-designed patterns with or without the use of stencils.

The elastomeric coating can be applied to a fabric in predetermined areas to minimize or eliminate undesirable bulges of body fat when the garment is worn. The elastomeric coating increases the modulus of the fabric in areas where it is applied, thereby providing compression over a specific area of the garment wearer when the garment is worn. Thus, a single panel of fabric can be designed to possess varied compression features at multiple locations as desired.

The thickness of an elastomeric coating can be varied by techniques including, but not limited to, varied diameter of apertures of a single silkscreen and varied squeegee pressures. The thickness can vary linearly along the entire extent of an individual coating area. The thickness can vary in a repeating pattern such that the thickness varies linearly over a portion of the fabric and the thickness profile over that portion is repeated successively along the extent of the coated fabric. Gaps where no elastomeric coating is applied can be located between successive portions. Further, the thickness can vary in a non-linear manner.

The elastomeric coating can be applied to the interior, exterior, or both sides of a garment. The elastomeric coating including various designs, patterns, and builds in various orientations as mentioned above, such as to form X-patterns for example, can also contribute to the visual aesthetics of the garment, especially if the elastomeric coating is applied to the exterior of the garment or is visible from the exterior of the garment. Enhancements such as, but not limited to, coloring of the elastomeric coating as well as the addition of pigments to the elastomeric coating can also be used to further improve the visual aesthetics of a garment.

The elastomeric coating can be located on the interior of a fabric panel can be embedded with flock fibers to increase the aesthetics and the comfort to the wearer. One end of each flocked fiber can be embedded in the elastomeric adhesive. The flock fibers can be attracted to the adhesive by, for instance, electrostatic charges. The fibers of the flocking can be formed from any natural or synthetic material, including any fibers described above. Exemplary synthetic materials include, but are not limited to, nylons, polyamides, polyesters such as terephthalate polymers and acrylic. Exemplary natural materials include cotton, silk, rayon, and wool. A conductive coating or finish can be applied continuously or discontinuously over the exterior surface of the flocking fibers to permit the flocking fibers to hold an electrical charge.

The length of the fiber used for flocking can be varied as appropriate. In some embodiments, the flocking fibers are short. In some embodiments, the flocking fibers are long. In some embodiments, the flocking fibers are linear. In some embodiments, the flocking fibers are shaped (e.g., curled, crimped, or bent). The fibers can be substantially perpendicular to the elastomeric coating, randomly oriented, angled between perpendicular and parallel orientations, or substantially parallel depending on a variety of design factors. In some embodiments, the flocking fibers are made by chopping or cutting a length of filament to a desired length.

Figure 2:
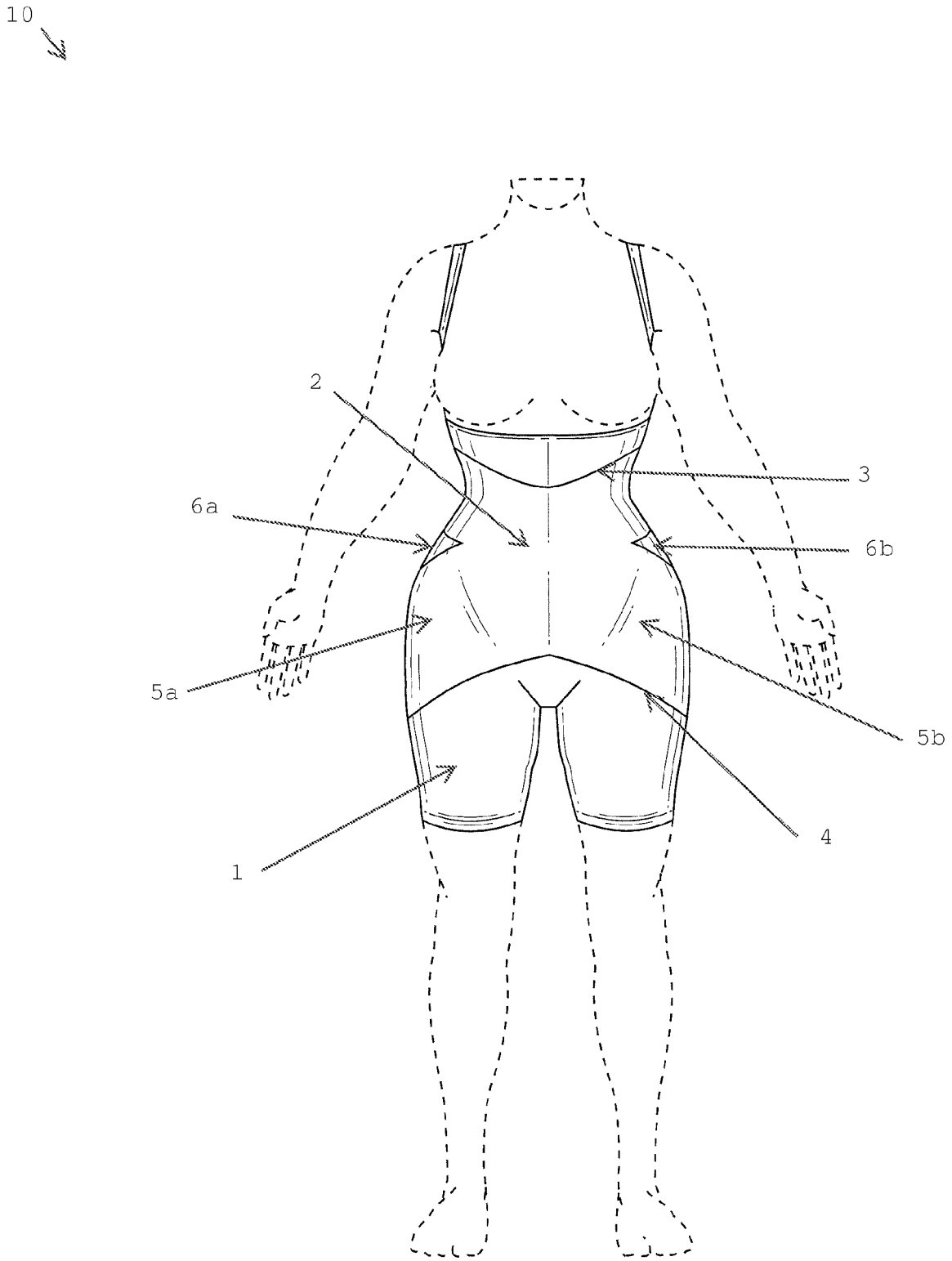
FIG. 2 depicts an anterior view of one embodiment of a flocked shapewear garment disclosed herein.
Figure 3:
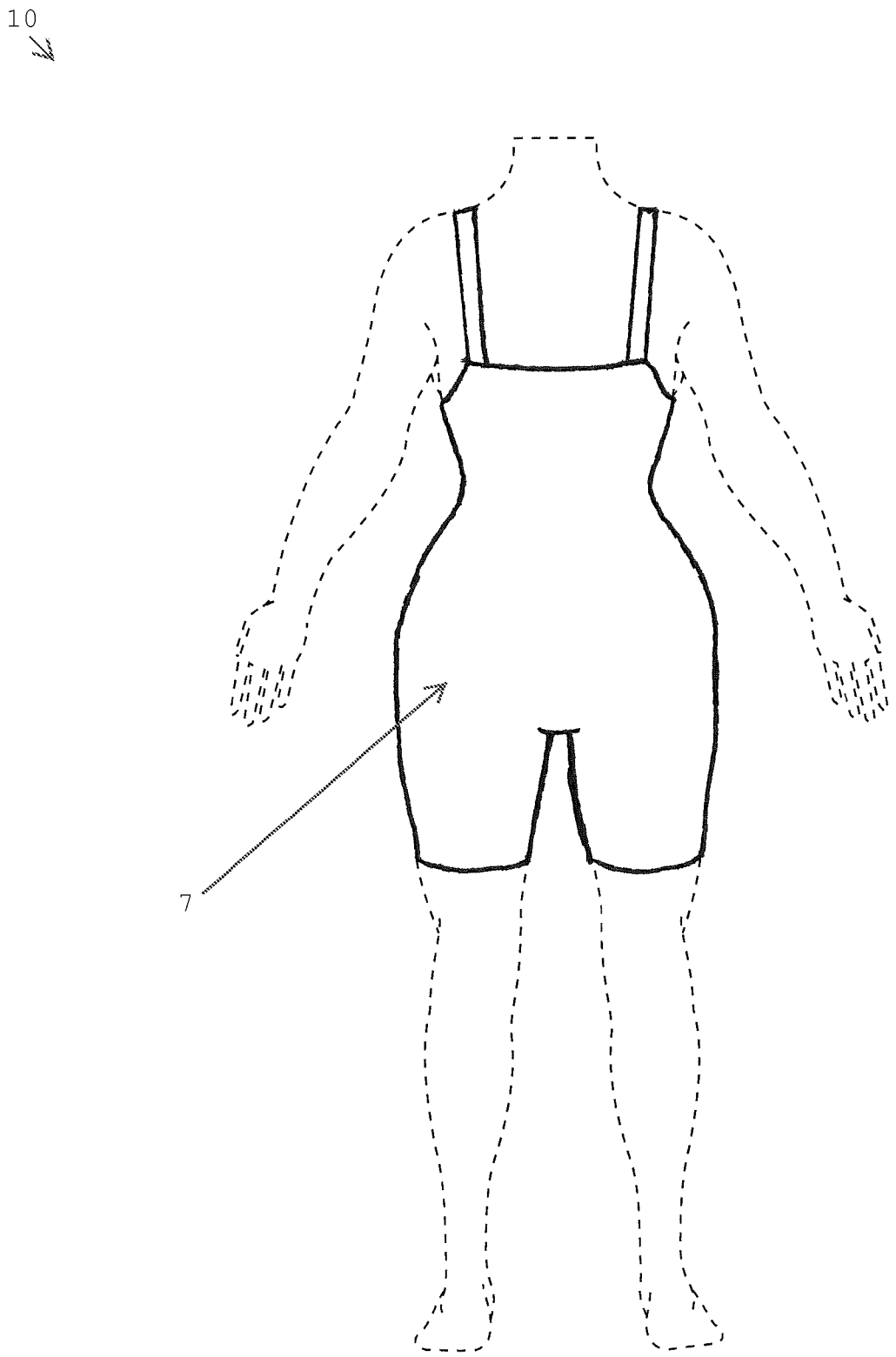
FIG. 3 depicts a posterior view of one embodiment of a flocked shapewear garment disclosed herein.

Also disclosed herein is a flocked shapewear garment 10, shown in FIGS. 1-3 (wherein FIGS. 1 and 2 depict the anterior view 1 of the garment wearer, and FIG. 3 depicts the posterior view 7 of the garment wearer), for tummy control of a wearer, the garment comprising a fabric panel configured to extend anteriorly over the wearer, and a flocked portion 2 of the fabric panel, the flocked portion having a tummy covering portion 2 and a pair of lateral portions 5*a*, 5*b* extending laterally therefrom, at least one of the lateral portions having at least one bifurcation defining a cutout portion 6*a*, 6*b*. The cutout portion can expand progressively as it extends laterally to the adjacent hip of the wearer. In some embodiments, both of the lateral portions have bifurcations defining the cutout portions. The flocked portion can include a superior edge 3 and an inferior edge 4. The superior and inferior edges have a minimal distance from each other over the tummy (e.g., from 6 inches to 15 inches). In some embodiments, the superior and inferior edges progressively diverge from each other extending away from the tummy in the lateral direction. The superior and inferior edges can have a minimal distance from each other of from 8 inches to 18 inches in the lateral portions. In some embodiments, the cutout portions are located nearer to the superior edge than to the inferior edge.

The garments and methods of the appended claims are not limited in scope by the specific garments and methods described herein, which are intended as illustrations of a few aspects of the claims and any garments and methods that are functionally equivalent are intended to fall within the scope of the claims. Various modifications of the garments and methods in addition to those shown and described herein are intended to fall within the scope of the appended claims. Further, while only certain representative garments and method steps disclosed herein are specifically described, other combinations of the garments and method steps also are intended to fall within the scope of the appended claims, even if not specifically recited. Thus, a combination of steps, elements, components, or constituents may be explicitly mentioned herein; however, other combinations of steps, elements, components, and constituents are included, even though not explicitly stated. The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also disclosed.

What is claimed is:

1. A method of making a compression region for a lower body shapewear garment, the method comprising:

providing a first fabric panel comprising an abdominal region, the abdominal region configured to extend over the abdominal area of a wearer wearing the garment, applying an elastomeric coating to the abdominal region of the garment, wherein the elastomeric coating is at least partially defined by a superior edge and an inferior edge and comprises a central portion positioned between the superior and inferior edges, and wherein the superior edge and the inferior edge diverge from each other extending laterally away from the central portion, and applying flocked fibers to the elastomeric coating to form the compression region.

2. The method of claim 1, wherein applying the elastomeric coating comprises placing the fabric panel beneath a silkscreen and passing an elastomeric coating substance through screen apertures of a silkscreen.

3. The method of claim 1, wherein the fabric panel is seamlessly constructed and comprises two leg regions configured to extend around the legs of a wearer wearing the garment.

4. The method of claim 1, wherein the fabric panel is attached to one or more additional fabric panels to create leg regions during construction of the lower body shapewear garment, wherein the leg regions are configured to extend around the legs of a wearer wearing the garment.

* * * * *